US010371345B2

(12) United States Patent
Nolan et al.

(10) Patent No.: US 10,371,345 B2
(45) Date of Patent: Aug. 6, 2019

(54) LIGHT EMITTING DIODE (LED) MODULE FOR LED LUMINAIRE

(71) Applicant: Eaton Intelligent Power Limited, Dublin (IE)

(72) Inventors: Christopher D. Nolan, Syracuse, NY (US); Joseph R. Casper, Syracuse, NY (US); Walten Peter Owens, Syracuse, NY (US); Joseph J. Witkowski, Syracuse, NY (US)

(73) Assignee: Eaton Intelligent Power Limited, Dublin (IE)

( * ) Notice: Subject to any disclaimer, the term of this patent is extended or adjusted under 35 U.S.C. 154(b) by 266 days.

(21) Appl. No.: 15/388,907

(22) Filed: Dec. 22, 2016

(65) Prior Publication Data

US 2017/0184272 A1 Jun. 29, 2017

Related U.S. Application Data

(60) Provisional application No. 62/271,509, filed on Dec. 28, 2015.

(51) Int. Cl.

| | |
|---|---|
| ***F21S 2/00*** | (2016.01) |
| ***F21V 3/00*** | (2015.01) |
| ***F21V 15/01*** | (2006.01) |
| ***F21V 21/30*** | (2006.01) |
| ***F21V 23/06*** | (2006.01) |

(Continued)

(52) U.S. Cl.

CPC ..... *F21V 3/00* (2013.01); *F21S 2/005* (2013.01); *F21V 15/01* (2013.01); *F21V 21/30* (2013.01); *F21V 23/06* (2013.01); *F21V 29/503* (2015.01); *F21V 29/507* (2015.01); *F21V 29/508* (2015.01); *F21V 29/74* (2015.01); *F21V 29/85* (2015.01); *F21V 29/87* (2015.01); *F21W 2131/105* (2013.01); *F21Y 2113/00* (2013.01); *F21Y 2115/10* (2016.08)

(58) Field of Classification Search

CPC ..... F21V 17/104; F21V 17/107; F21V 17/14; F21V 17/16; F21V 17/164; F21V 19/003; F21V 19/0035; F21V 19/004; F21V 19/0045; F21V 29/87; F21V 29/85; F21V 29/503; F21V 29/508

See application file for complete search history.

(56) References Cited

U.S. PATENT DOCUMENTS

| | | | |
|---|---|---|---|
| 6,389,690 | B1 | 5/2002 | McCullough et al. |
| 8,157,412 | B2 | 4/2012 | Lin et al. |

(Continued)

*Primary Examiner* — Alexander K Garlen
*Assistant Examiner* — Colin J Cattanach
(74) *Attorney, Agent, or Firm* — Fox Rothschild LLP

(57) ABSTRACT

A light emitting diode (LED) module for a light fixture includes a substrate with an upper surface and a lower surface. Various pressure multiplying pads are integrally connected to the lower surface, and each pressure multiplying pad extends away from the lower surface. LEDs are attached to the upper surface, along with a set of conductive lines so that each conductive line electrically connects a corresponding LED to a power inputs. Each of the pressure multiplying pads may be positioned opposite a corresponding LED. A flexible lens cover may cover the upper surface and the LEDs, while leaving the lower surface and pressure multiplying pads exposed so that the pads can contact a heat sink of the light fixture.

22 Claims, 8 Drawing Sheets

(51) Int. Cl.

| | |
|---|---|
| ***F21V 29/74*** | (2015.01) |
| ***F21V 29/85*** | (2015.01) |
| ***F21V 29/87*** | (2015.01) |
| ***F21V 29/503*** | (2015.01) |
| ***F21V 29/508*** | (2015.01) |
| ***F21Y 115/10*** | (2016.01) |
| ***F21V 29/507*** | (2015.01) |
| *F21W 131/105* | (2006.01) |
| *F21Y 113/00* | (2016.01) |

(56) References Cited

U.S. PATENT DOCUMENTS 9,316,447 B2 * 4/2016 Fleskens ..... F28F 3/00
2006/0124953 A1 * 6/2006 Negley ..... H01L 33/486 257/99
2010/0328947 A1 * 12/2010 Chang ..... F21V 19/0045 362/249.02
2011/0211351 A1 * 9/2011 Van De Ven ..... F21K 9/238 362/249.02
2013/0044501 A1 * 2/2013 Rudisill ..... F21V 29/70 362/398
2013/0105850 A1 * 5/2013 Komatsu ..... H01L 33/505 257/98
2014/0140074 A1 * 5/2014 Chen ..... F21V 17/164 362/373
2014/0264393 A1 * 9/2014 McCanless ..... H05K 1/021 257/88
2014/0334149 A1 11/2014 Nolan et al.
2015/0036363 A1 * 2/2015 Fleskens ..... H01L 23/42 362/382
2015/0128409 A1 * 5/2015 Chen ..... F21V 31/04 29/829
2015/0167937 A1 6/2015 Casper et al.
2015/0219323 A1 * 8/2015 Baek ..... F21K 9/64 362/235
2016/0209023 A1 * 7/2016 Tseng ..... F21V 31/005
2018/0066815 A1 * 3/2018 Chen ..... F21V 31/005

* cited by examiner

LIGHT EMITTING DIODE (LED) MODULE FOR LED LUMINAIRE

RELATED APPLICATIONS AND CLAIM OF PRIORITY

This patent document claims priority to U.S. provisional patent application No. 62/271,509, filed Dec. 28, 2015, the disclosure of which is hereby incorporated by reference in full.

BACKGROUND

The advent of light emitting diode (LED) based luminaires has provided sports arenas, stadiums, other entertainment facilities, and other commercial and industrial facilities the ability to achieve instant on-off capabilities, intelligent controls and adjustability while delivering excellent light quality, consistent light output, and improved energy efficiency. Because of this, users continue to seek improvements in LED lighting devices. For example, new and improved ways to direct light in multiple directions, and to provide luminaires with high light output in a compact package, are desired.

This document describes new illumination devices that are directed to solving the issues described above, and/or other problems.

SUMMARY

In an embodiment, a light emitting diode (LED) module for an LED light fixture includes a substrate with an upper surface and a lower surface. The module may include at least one power input. A group of pressure multiplying pads are integrally connected to the lower surface and extend away from the lower surface. A group of LEDs are positioned over the upper surface and attached to the upper surface, optionally with via one or more intermediate components. A set of conductive lines is positioned so that each conductive line electrically connects a corresponding LED to a power input. A flexible lens cover may be shaped to fit over the upper surface and around the ridge while leaving at least a portion of the lower surface exposed.

Each of the pressure multiplying pads may be positioned opposite a corresponding LED. Each of the pressure multiplying pads may extend beyond a lower surface of any sidewall of the substrate The LED module may be included within a light fixture comprising a heat sink body. If so, the LED module is positioned within an opening of the heat sink body. If so, the pressure multiplying pads and one or more connecting structures may be the only components of the LED module that physically contact the heat sink body.

The substrate and/or other components of the LED module may be coated with a parylene material. For example, the LED module may be partially coated with a parylene material so that the parylene material is a part of the pressure multiplying pads and provides a thermal transfer function between the pressure multiplying pads and the heat sink body.

The substrate may include a ridge positioned around its perimeter of the substrate. If so, the flexible lens cover may be shaped to fit over the upper surface and around the ridge.

The LED module may include a layer of electrically non-conductive, thermally conductive material positioned between the conductive lines and the upper surface so that, in operation, the LEDs and conductive lines are electrically separated from the substrate while heat from the LEDs passes through the layer to the substrate. The layer may be selectively positioned under the LEDs and conductive lines so that the layer does not fully cover the substrate.

BRIEF DESCRIPTION OF THE DRAWINGS

FIG. 4 illustrates a bottom view of the substrate of FIG. 3, while

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a light fixture is oriented in a first direction. The relative orientations of the components may be reversed, or the components may be on the same plane, if the orientation of a light fixture that contains the components is changed. The claims are intended to include all orientations of a device containing such components.

As used in this document, the term "connected" means having a connected relationship, either directly or indirectly via one or more intermediary elements. A connection may be either a structural connection in which components are physically connected, or an electrical connection in which components are directly or indirectly connected so that power and/or control signals may pass between the components via one or more conductors.

Figure 1:
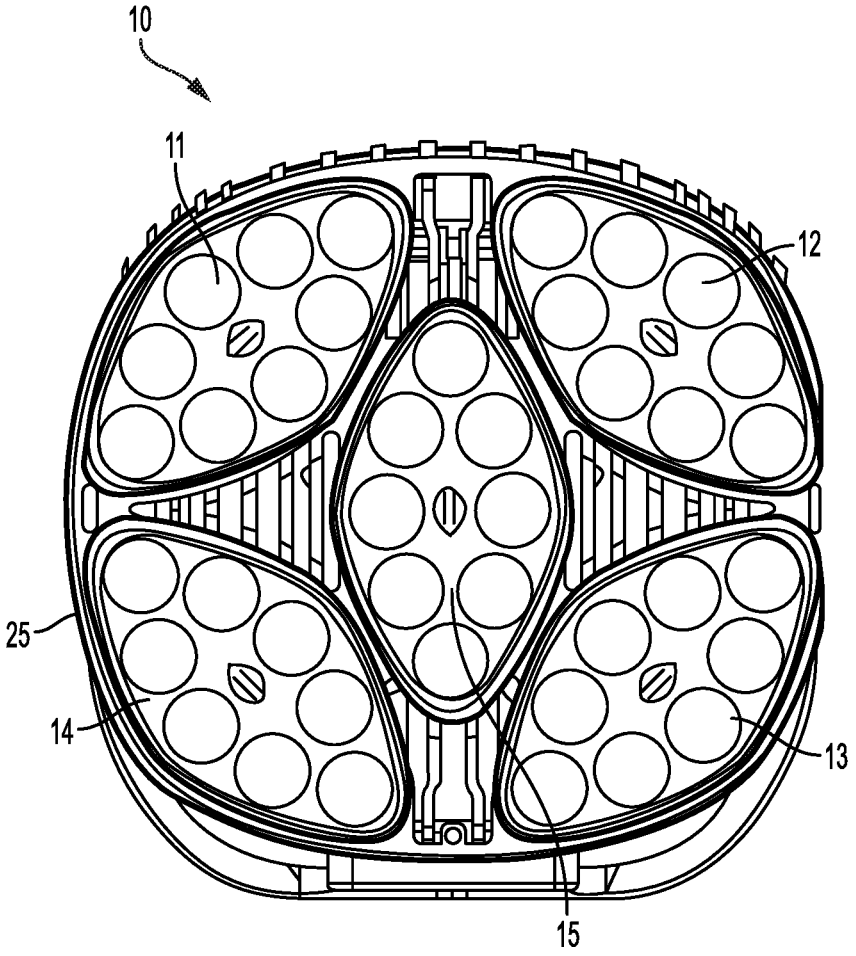
FIG. 1 illustrates a front view of an example of one embodiment of an illumination device that may incorporate LED modules such as those disclosed in this document.
Figure 2:
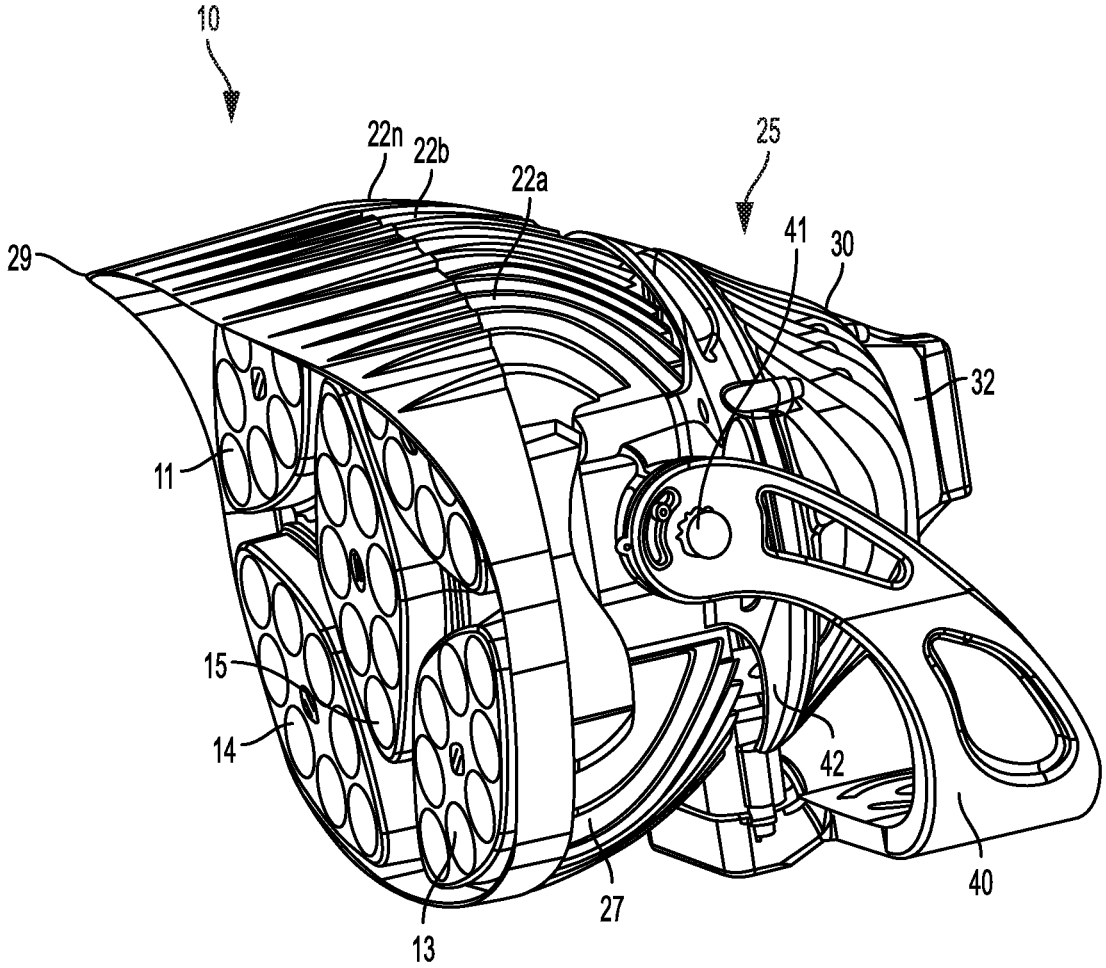
FIG. 2 illustrates a view from one side of the device of FIG. 1.

FIG. 1 illustrates a front view of an example of one embodiment of the illumination devices disclosed in this document. FIG. 2 illustrates a view from one side of the device of FIG. 1, while FIG. 2 provides a perspective view. The illumination device 10 includes a housing 25 that encases various components of a light fixture. As shown in FIG. 1, the housing 25 includes an opening in which a set of light emitting diode (LED) modules 11-15 are secured to form a multi-module LED structure. The LED modules 11-15 are positioned to emit light away from the fixture. Each LED module includes a frame that holds a set of LEDs arranged in an array or other configuration. In various embodiments the number of LEDs in each module may be any number that is sufficient to provide a high intensity LED device. Each LED module will also include a substrate on which the LEDs, various conductors and/or electronic devices, and lenses for the LEDs are mounted.

The opening of the housing 25 may be circular, square, or a square with round corners as shown in FIG. 1, although other shapes are possible. The LED modules 11-15 may include five modules as shown, with four of the modules 11-14 positioned in a quadrant of the opening and the fifth module 15 positioned in the center as shown. Alternatively, any other number of LED modules, such as one, two, three, four or more LED modules, may be positioned within the opening in any configuration.

The device's housing 25 includes a body portion 27 and an optional shroud portion 29. The body portion 27 serves as a heat sink that dissipates heat that is generated by the LED modules. The body 27 (or the heat sink) may be formed of aluminum and/or other metal, plastic or other material, and it may include any number of fins 22*a* . . . 22*n* on the exterior to increase its surface area that will contact a surrounding cooling medium (typically, air). Thus, the body portion 27 or the entire housing 25 may have a bowl shape as shown, the LED modules 11-15 may fit within the opening of the bowl, and heat from the LED modules 11-15 may be drawn away from the LED modules and dissipated via the fins 22*a* . . . 22*n* on the exterior of the bowl.

While the LED modules are positioned at the front of body portion 27, the opposing side of the body portion may be attached to a power supply housing 30, optionally via a thermal interface plate. The power supply housing 30 may include a battery, solar panel, or circuitry to receive power from an external and/or other internal source. A power supply housing 30 may be positioned at the rear of the body (i.e., at the bottom of the bowl), and the interior of the unit may include wiring or other conductive elements to transfer power and/or control signals from the power supply housing 30 to the LED modules 11-15. The power supply housing 30 may be positioned at or near the rear of the body as shown, or it may be placed into another portion of the body so that it is flush or substantially flush with the rear of the body 27, or it may be configured to extend to some point between being flush with the body portion 27 and an extended position. A sensor cavity 32 may be attached to the power supply and/or other part of the device as shown, and it may contain sensors and/or control and communications hardware for sensing parameters of and controlling the device, receiving commands, and transmitting data to remote control devices.

The housing 25 may be formed as a single piece, or it may be formed of two pieces that fit together as in a clamshell-type structure. In a clamshell design, a portion of the interior wall of the clamshell near its opening may include a groove, ridge, or other supporting structure that is configured to receive and secure the LED structure in the opening when the clamshell is closed. In addition, the fins 22*a* . . . 22*n* may be curved or arced as shown, with the base of each fin's curve/arc positioned proximate the opening/LED modules, and the apex of each fin's curve/arc positioned distal from the opening/LED modules to further help draw heat away from the LED modules. The housing may be attached to a support structure 40, such as a base or mounting yoke, optionally by one or more connectors 41. As shown, the connectors 41 may include axles about which the housing and/or support structure may be rotated to enable the light assembly to be positioned to direct light at a desired angle.

The power supply housing 30 may be detachable from remainder of the lighting device's housing 25 so that it can be replaced and/or removed for maintenance without the need to remove the entire device from an installed location, or so that it can be remotely mounted to reduce weight. The power supply unit 30 and/or a portion of the lighting unit housing 25 may include one or more antennae, transceivers or other communication devices that can receive control signals from an external source. For example, the illumination device may include a wireless receiver and an antenna that is configured to receive control signals via a wireless communication protocol. Optionally, a portion of the lighting unit housing 25 or shroud 29 (described below) may be equipped with an attached laser pointer that can be used to identify a distal point in an environment to which the lighting device directs its light. The laser pointer can thus help with installation and alignment of the device to a desired focal point.

FIGS. 1 and 2 show that the device may include a shroud 29 that protects and shields the LED modules 11-15 from falling rain and debris, and that may help direct light toward an intended illumination surface. The shroud 29 may have any suitable width so that an upper portion positioned at the top of the housing is wider than a lower portion positioned at the bottom and/or along the sides of the opening of the housing. This may help to reduce the amount of light wasted to the atmosphere by reflecting and redirecting stray light downward to the intended illumination surface.

Figure 3:
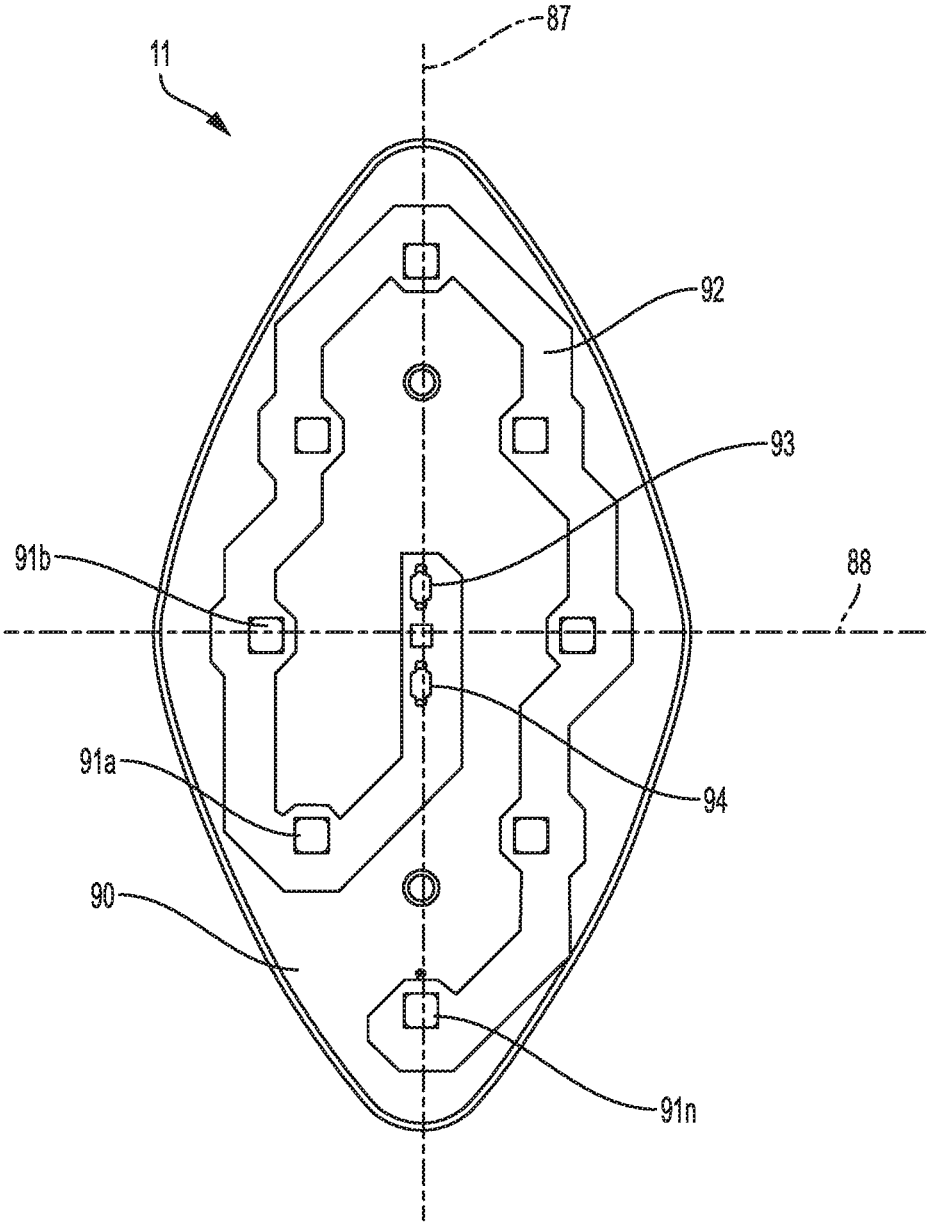
FIG. 3 illustrates a top view of an example of a substrate for an LED module.

FIG. 3 illustrates a top view of an example of an LED module 11, with the lens cover removed. The module 11 includes a substrate 90 having an upper surface (shown in FIG. 3) on which a plurality of LEDs 91*a* . . . 91*n* and conductive lines 92 are etched, printed, deposited, adhered or otherwise applied. The module's substrate 11 may have any desired shape, such as a diamond, shape, ellipsoid shape, or a combination of the two as shown in FIG. 3.

The substrate 90 may be formed of a rigid, semi-rigid or flexible material. For example, the substrate 90 may be formed of aluminum, steel, copper, steel, another metal or an alloy of any such metal; graphene or other carbon-based material; a graphene-metal composite; or other composite materials. The conductive lines 92 may be copper, silver or another conductive material and applied as conductive ink, wire, traces, or other materials to provide a conductive pathway between one or more power inputs 93, 94. The power inputs 93, 94 may be connected to the power supply (typically via an intervening control circuit that is connected to the power supply) via one or more conductive elements that pass through the body portion of the luminaire. In operation, power is received from the inputs 93, 94 and delivered to the LEDs 91*a* . . . 91*n* via the conductive lines 92.

FIG. 3 shows that the LEDs 91*a* . . . 91*n* are printed, adhered or otherwise affixed to the substrate 90 so that each LED is connected to one or more of the conductive lines 92. Any number of LEDs may be provided. The upper surface of the substrate 90 (i.e., the side of the substrate shown in FIG. 3) may include cavities, indentations and/or other recessed areas, each of which is positioned to receive an LED and/or a conductive trace.

In the embodiment shown in FIG. 3, the LEDs 91*a* . . . 91*n* are positioned symmetrically on either side of a first central axis 87 of the substrate 11. In this embodiment the LEDs 91*a* . . . 91*n* are also positioned symmetrically on either side of a second central axis 88 of the substrate 11, where the first central axis 87 and second central axis 88 are perpendicular to each other so that they intersect at a center point of the substrate and provide four quadrants with equal numbers of LEDs in similar positions in each quadrant.

Figure 4:
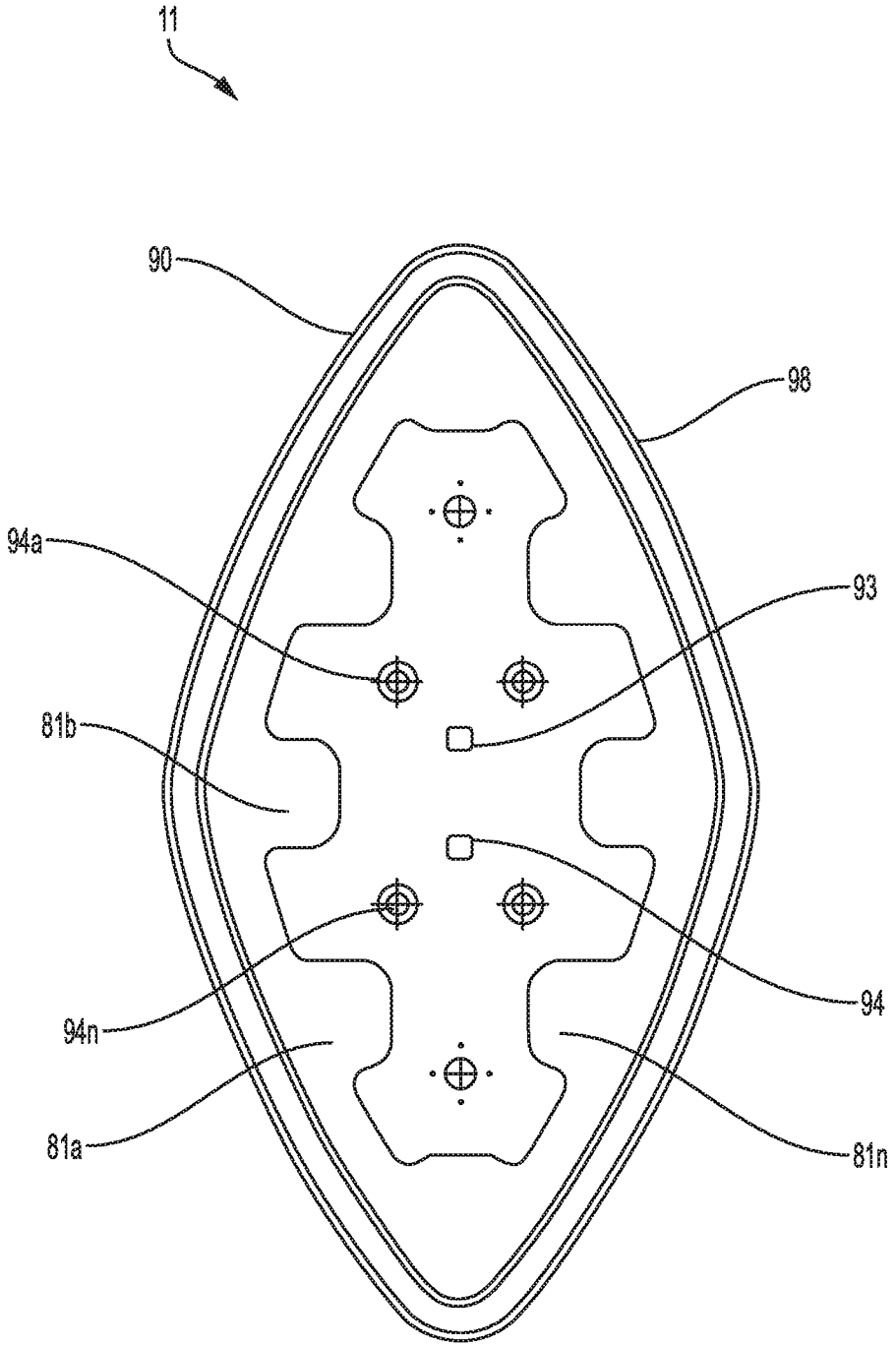
Figure 5:
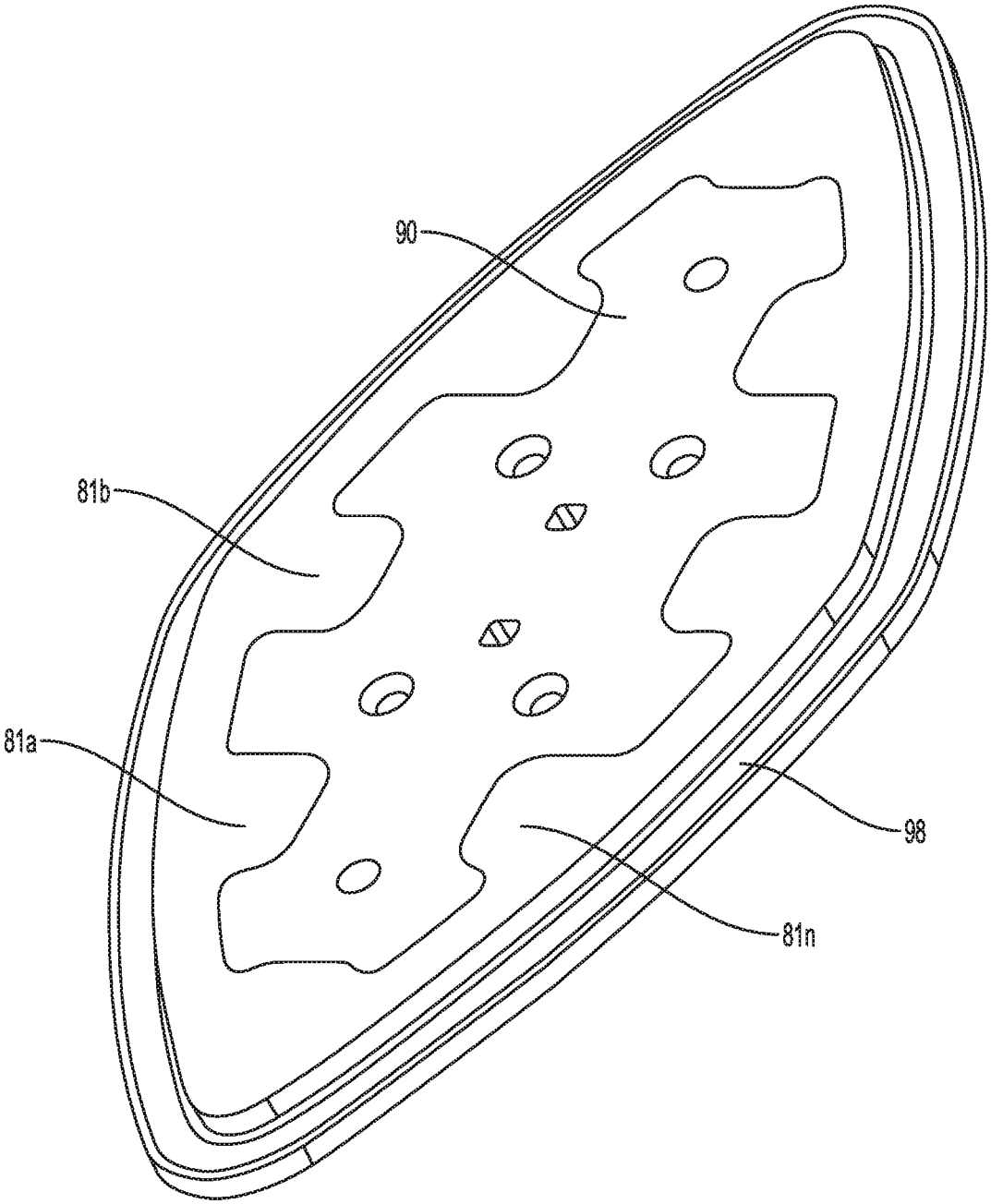
FIG. 5 is a perspective view of the substrate.

FIGS. 4 and 5 show an underside of the LED module 11, in which a lower surface of the substrate 90 includes a number of pressure multiplying pads 81*a* . . . 81*n* that are positioned on a lower side of the substrate (i.e., the side that is opposite the LEDs). The exact configuration of pressure multiplying pads 81*a* . . . 81*n* may vary based on the desired size, shape and strength of the module. As shown in FIG. 4, the position of each of the pressure multiplying pads 81*a* . . . 81*n* may be such that each pad is placed under a corresponding LED to serve as an LED support pad and provide pressure against the LED when the LED module is installed in a light fixture. Each pressure multiplying pad is a surface or portion of a surface positioned to extend from the substrate, or as an integral extension (as shown in FIG. 4) in which each pressure multiplying pad is a region of a larger surface. The distance by which each pad extends from the substrate may vary, such as a distance from about 0.1 inch to about 0.25 inches. Other distances may be used in various embodiments.

Each pressure multiplying pad 81*a* . . . 81*n* has a thickness that extends beyond the thickest portion of any sidewall of the module so that in operation, the support pads are assured to have a direct physical contact with a fin, mating surface or other component of the heat sink that is connected to the LED module. Optionally, each pressure multiplying pad may be a pad as shown that extends inward from a position proximate an outer edge of the substrate. Thus, the pressure multiplying pads and substrate may also form part of a heat sink to dissipate heat from the LEDs. When an LED module is bolted or otherwise connected to a mating surface (such as via bolts that extend through holes 94*a* . . . 94*n*), the bolts or other connecting devices will add pressure so that the pressure multiplying pads snugly connect to the opposing component of the heat sink. The central area of the substrate (where bolts are applied through holes 94*a* . . . 94*n*) has a thickness that is less than that of the pressure multiplying pads so that when the module is connected to a component of the heat sink, the upper surface of the substrate causes the pressure multiplying pads to be compressed against the heat sink.

The LED support pads may be integrally formed with, and formed of the same material as, the substrate 90 and supporting members 98*a* . . . 98*n*. Alternatively, the LED support pads may be formed of a different material and attached to the substrate 90 by any suitable structure such as an adhesive material or a mechanical fit.

The substrate 90 and support pads 81*a* . . . 81*n* may be formed together as a single structure by casting, forging, molding, extruding or any other suitable process. Alternatively, the substrate 90 and support pads 81*a* . . . 81*n* may be separately formed by such processes and connected by an adhesive, by welding, or by bolts, clamps or other connectors. Either way, the semi-finished product (or components) may be machined to remove rough and/or uneven portions and yield a finished product.

Figure 6:
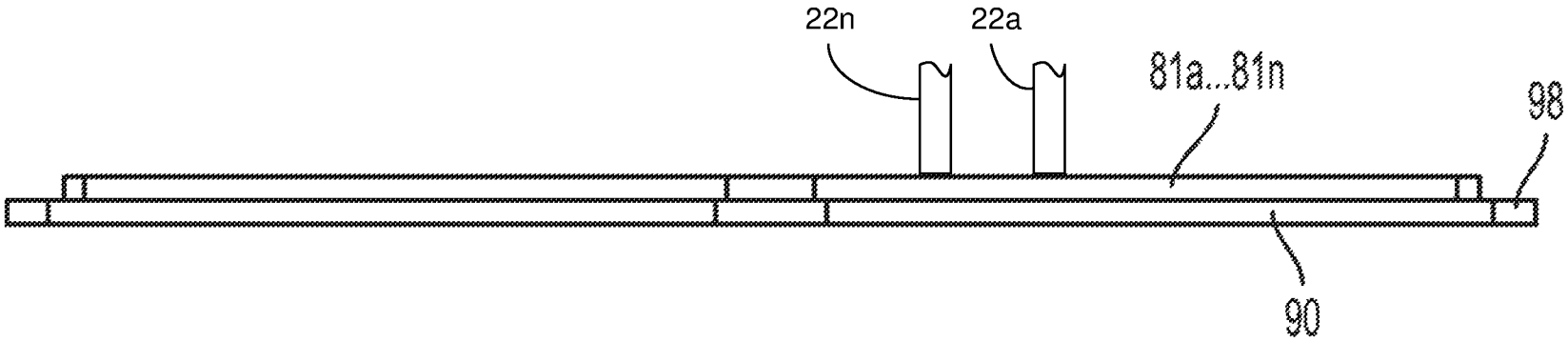
FIG. 6 is a side view of the substrate.
Figure 7:
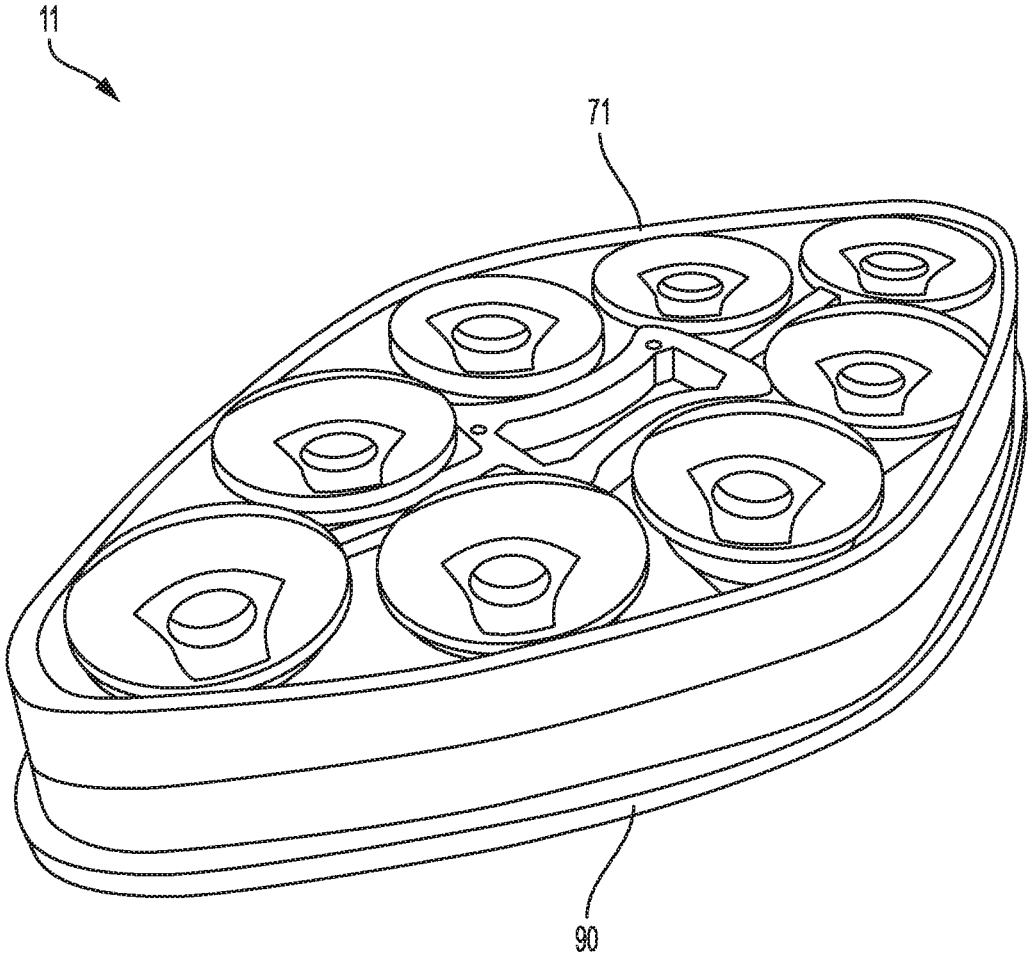
FIG. 7 is a perspective view of an LED module that may incorporate substrates such as that described in this document.

FIG. 6 shows a side view of the substrate 90, in which the pressure multiplying pads 81*a* . . . 81*n* extend up from, and have a thickness greater than, the remainder of the substrate. FIG. 6 also shows that the substrate may include a ridge 98 around its perimeter. The ridge 98 has a thickness less than that of the pressure multiplying pads 81*a* . . . 81*n* so that a flexible lens cover may be wrapped around and connect to the ridge 98, thus covering the side of the substrate that has the LEDs while leaving at least a portion of the lower surface and pressure multiplying pads exposed so that the pads can contact a heat sink (represented by fins 22*a* . . . 22*n*) of the light fixture. FIG. 7 illustrates how such a cover 71 may be applied to a substrate 90 in practice to form a LED module 11.

Figure 8:
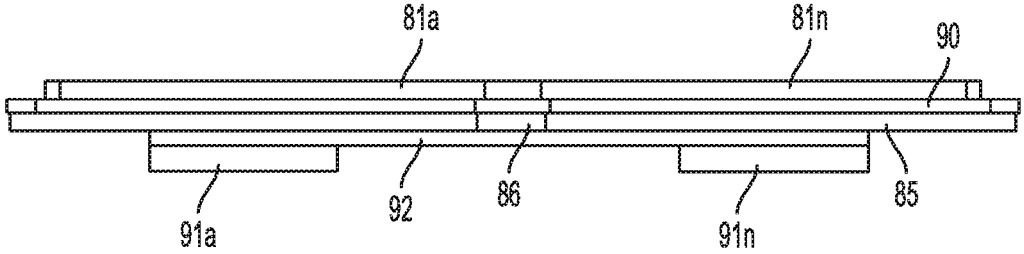
FIG. 8 illustrates a side view of the substrate with additional optional layers between the substrate and the module's LEDs.

FIG. 8 illustrates that in some embodiments, additional layers may be provided on a side of the substrate that is opposite the pressure multiplying pads to facilitate heat dissipation from the LEDs and/or other desirable properties. For example, as shown in FIG. 8 a substrate 90 made of aluminum or another suitable material may have pressure multiplying pads 81*a* . . . 81*n* positioned on one side of the substrate. The opposite side of the substrate 95 may be partially or fully coated with a dielectric layer 85 of material that electrically separates the conductive lines 92 from the substrate 90. The dielectric layer 85 provides electric isolation under the LEDs but allows heat to pass from the LEDs 91*a* . . . 91*n* to the substrate 90 (and thus to the heat sink). Example electrically non-conductive/thermally conductive materials include aluminum nitride, beryllium oxide, alumina, silicon and ceramic materials. Optionally, the electrically non-conductive/thermally conductive layer 85 may be applied to the whole substrate 90, or it may be selectively applied to be positioned under the LEDs, while leaving spaces open in at least some areas 86 of the substrate on which LEDs are not positioned.

Optionally, the substrate and other portions of the LED module may be coated with a conformal coating to provide environmental protection for the module while limiting thermal resistance between the LED module and the heat sink. The coating may comprise parylene, silicone, polyurethane, acrylic or another material be applied by chemical vapor deposition or any other suitable application process. Suitable coatings and materials are described in, for example: U.S. Patent Application Pub. No. 2009014227 to Fuchs et al., or U.S. Pat. No. 6,389,690 to McCullough et al. (The disclosures of each document listed in the previous sentence are fully incorporated herein by reference.) The coating may be applied to all of the exterior of the LED module (i.e., over the top, bottom and sides) after the LEDs and conductive lines are applied to the substrate, or it may be selectively applied to various portions of the LED module.

It is intended that the portions of this disclosure describing LED modules and control systems and methods are not limited to the embodiment of the illumination devices disclosed in this document. The LED modules, control systems and control methods may be applied to other LED illumination structures, such as those disclosed in U.S. Patent Application Pub. No. 2014/0334149 (filed by Nolan et al. and published Nov. 13, 2014), and in U.S. Patent Application Pub. No., 2015/0167937 (filed by Casper et al. and published Jun. 18, 2015), the disclosures of which are fully incorporated herein by reference.

The features and functions described above, as well as alternatives, may be combined into many other systems or applications. Various presently unforeseen or unanticipated alternatives, modifications, variations or improvements may be made by those skilled in the art, each of which is also intended to be encompassed by the disclosed embodiments.

The invention claimed is:

1. A light emitting diode (LED) module for an LED light fixture comprising:

a substrate that comprises:

an upper surface, a lower surface, at least one power input, and a plurality of pressure multiplying pads, each of which is integrally connected to a portion of the lower surface and extending away from the lower surface, and wherein the pressure multiplying pads are arranged so that a portion of the lower surface does not have any of the pressure multiplying pads connected to it;

a plurality of LEDs positioned over the upper surface; and a plurality of conductive lines positioned so that each conductive line electrically connects a corresponding LED to at least one of the power inputs.

2. The LED module of claim 1, wherein the LED module is coated with a parylene material.

3. The LED module of claim 1, wherein each of the pressure multiplying pads is positioned under a corresponding LED.

4. The LED module of claim 3, wherein each of the pressure multiplying pads extends beyond a lower surface of any sidewall of the substrate.

5. The LED module of claim 1, wherein:

the LED module is included within a light fixture comprising a heat sink body; and the LED module is positioned within an opening of the heat sink body.

6. The LED module of claim 5, wherein the LED module is at least partially coated with a parylene material so that the parylene material is a part of the pressure multiplying pads and provides a thermal transfer function between the pressure multiplying pads and the heat sink body.

7. The LED module of claim 1, further comprising:

a ridge positioned around a perimeter of the substrate; and a flexible lens cover shaped to fit over the upper surface and around the ridge while leaving at least a portion of the lower surface exposed.

8. The LED module of claim 1, further comprising a layer of electrically non-conductive, thermally conductive material positioned between the conductive lines and the upper surface so that, in operation, the LEDs and conductive lines are electrically separated from the substrate while heat from the LEDs passes through the layer to the substrate.

9. The LED module of claim 8, wherein the layer is selectively positioned under the LEDs and the conductive lines so that the layer does not fully cover the substrate.

10. The LED module of claim 1, wherein the pressure multiplying pads are formed together as a single structure.

11. The LED module of claim 1, wherein each of the pressure multiplying pads extends inward from a position proximate an outer edge of the substrate.

12. A light emitting diode (LED) module for an LED light fixture comprising:

a substrate that comprises:

an upper surface, a lower surface, a plurality of pressure multiplying pads, each of which is integrally connected to a portion of the lower surface and extending away from the lower surface, and wherein the pressure multiplying pads are arranged so that a portion of the lower surface does not have any of the pressure multiplying pads connected to it;

a plurality of LEDs positioned over the upper surface;

a plurality of conductive lines positioned so that each conductive line electrically connects a corresponding LED to a power input; and a flexible lens cover shaped to fit over the upper surface while leaving at least a portion of the lower surface exposed.

13. The LED module of claim 12, wherein the substrate is at least partially coated with a parylene material.

14. The LED module of claim 12, wherein each of the pressure multiplying pads is positioned under a corresponding LED.

15. The LED module of claim 14, wherein each of the pressure multiplying pads extends beyond a lower surface of any sidewall of the substrate.

16. The LED module of claim 12, wherein:

the LED module is included within a light fixture comprising a heat sink body; and the LED module is positioned within an opening of the heat sink body.

17. The LED module of claim 16, wherein the LED module is at least partially coated with a parylene material so that the parylene material is a part of the pressure multiplying pads and provides a thermal transfer function between the pressure multiplying pads and the heat sink body.

18. The LED module of claim 12, further comprising:

a ridge positioned around a perimeter of the substrate; and the flexible lens cover is shaped to fit over the upper surface and around the ridge.

19. The LED module of claim 12, further comprising a layer of electrically non-conductive, thermally conductive material positioned between the conductive lines and the upper surface so that, in operation, the LEDs and conductive lines are electrically separated from the substrate while heat from the LEDs passes through the layer to the substrate.

20. The LED module of claim 19, wherein the layer is selectively positioned under the LEDs and the conductive lines so that the layer does not fully cover the substrate.

21. The LED module of claim 12, wherein the pressure multiplying pads are formed together as a single structure.

22. The LED module of claim 12, wherein each of the pressure multiplying pads extends inward from a position proximate an outer edge of the substrate.

* * * * *